US010513808B2

(12) United States Patent
Chen

(10) Patent No.: US 10,513,808 B2
(45) Date of Patent: Dec. 24, 2019

(54) BRAIDING APPARATUS CAPABLE OF GENERATING ONE ROPE WITH DIFFERENT BRAID DENSITIES

(71) Applicant: Ming-Cheng Chen, Taichung (TW)

(72) Inventor: Ming-Cheng Chen, Taichung (TW)

( * ) Notice: Subject to any disclaimer, the term of this patent is extended or adjusted under 35 U.S.C. 154(b) by 324 days.

(21) Appl. No.: 15/484,343

(22) Filed: Apr. 11, 2017

(65) Prior Publication Data

US 2018/0291539 A1 Oct. 11, 2018

(51) Int. Cl.

| | |
|---|---|
| ***D04C 3/48*** | (2006.01) |
| ***D04C 3/38*** | (2006.01) |
| ***D07B 5/00*** | (2006.01) |

(52) U.S. Cl.

CPC ..... *D04C 3/48* (2013.01); *D04C 3/38* (2013.01); *D07B 5/005* (2013.01); *D07B 2201/1004* (2013.01); *D07B 2201/1096* (2013.01); *D07B 2207/20* (2013.01); *D07B 2207/4095* (2013.01)

(58) Field of Classification Search

CPC ..... D04C 3/38; D04C 3/48; D07B 5/005

See application file for complete search history.

(56) References Cited

U.S. PATENT DOCUMENTS 958,872 A * 5/1910 Holzhey et al. ..... D04C 1/06 139/384 R
2,102,829 A * 12/1937 Peter ..... D04C 3/48 87/11
5,037,404 A * 8/1991 Gold ..... A61M 25/0012 604/527
5,060,549 A * 10/1991 Beal ..... A63B 29/028 87/11
6,492,805 B1 * 12/2002 Wakabayashi ..... B60T 1/065 324/160
7,069,835 B2 * 7/2006 Nishri ..... D04C 1/02 87/11
7,171,925 B2 * 2/2007 Beil ..... F01L 13/02 123/41 E
2003/0221788 A1 * 12/2003 Dods ..... B65C 9/1884 156/541
2003/0221789 A1 * 12/2003 Dods ..... B65C 9/1884 156/569
2003/0234860 A1 * 12/2003 Sung ..... H04N 7/185 348/143
2004/0238233 A1 * 12/2004 Petrucelli ..... G01G 19/44 177/177

(Continued)

*Primary Examiner* — Shaun R Hurley

(74) *Attorney, Agent, or Firm* — Rosenberg, Klein & Lee

(57) ABSTRACT

A braiding apparatus includes a base, a strand supplier supplying a core strand, strand carriers shuttling on the base and providing carrier strands that wrap the core strand and twist together to form a rope, a guiding pulley disposed above the strand carriers to feed the rope to a strand collector, and a control device having a driving source connected to the guiding pulley, at least one recognition unit arranged on the guiding pulley, a sensor disposed relative to the guiding pulley, and a controller electrically connected to the sensor and the driving source. The sensor counts the number of the recognition unit passing the sensor when the guiding pulley rotates to measure lengths of divided sections of the rope. Concurrently, the controller controls the driving source and the guiding pulley to have different rotational speeds, thereby controlling different braid densities of different sections of the same rope precisely.

8 Claims, 6 Drawing Sheets

(56) References Cited

U.S. PATENT DOCUMENTS

2006/0209155 A1* 9/2006 Hwang ..... B41J 13/0018
347/104
2013/0100291 A1* 4/2013 Tan ..... G07F 19/207
348/150

* cited by examiner

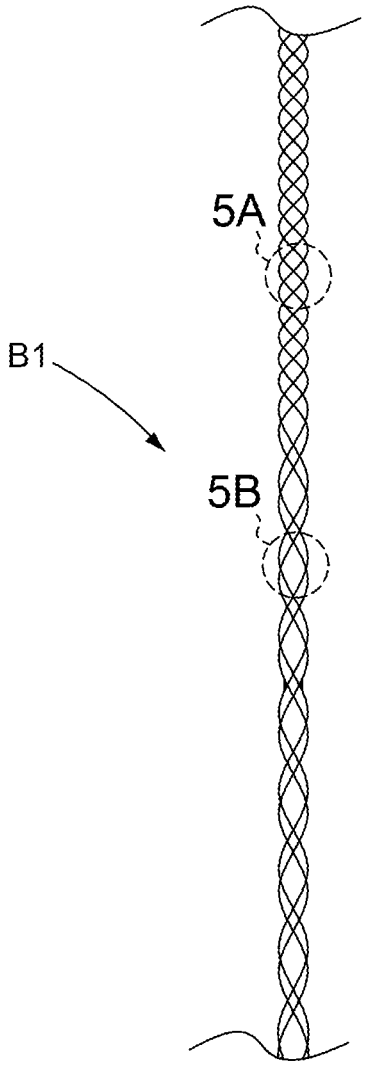
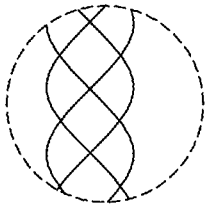
FIG. 5A
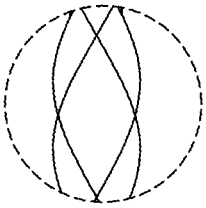
FIG. 5B
FIG. 5

BRAIDING APPARATUS CAPABLE OF GENERATING ONE ROPE WITH DIFFERENT BRAID DENSITIES

BACKGROUND OF THIS INVENTION

1. Field of this Invention

This invention relates to a braiding apparatus and relates particularly to a braiding apparatus capable of generating one twisted rope with different braid densities.

2. Description of the Related Art

FIG. 1 shows a conventional braiding apparatus 1 serving to twist many strands together to form a braided rope. The braiding apparatus 1 includes a base 11, a strand supplier 12 serving to feed at least core strand A to the base 11, strand carriers 13 with carrier strands shuttling on the base 11 for allowing the carrier strands to wrap the core strand A and become twisted together to form a braided rope A1, a guiding pulley 14 disposed above the carriers 13 and carrying the rope A1, a motor 151 and a gear box 152 connected to the guiding pulley 14, and a strand collector 16 serving to collect the rope A1 passing around the guiding pulley 14. Specifically, the gear box 152 is comprised of gears with different outer diameters, thereby allowing the power delivered from the motor 151 to obtain a fixed speed of rotation according to the gear ratio. Thus, the pulley 14 is rotated to pull and feed the rope A1 by an equal speed and assists the carriers 13 in braiding.

The use of the apparatus 1 still has problems. For example, the use of the fixed gear ratio of the gear box 152 allows the motor 151 to deliver a fixed power to the guiding pulley 14. Such operation can only form one rope A1 with a fixed braid density. In other words, the strands are twisted together by the same density throughout the rope A1. In practical, the rope A1 with the single braid density cannot meet the demand because the demand for the use of the rope A1 has changed and requires variety. There are some firms trying to adjust the braid density of the rope A1 by slowing down the movement of the carriers 13. However, the deceleration of the carriers 13 cannot be easily achieved because of the recent limited mechanism. The deceleration may be manually operated, but the manual operation cannot control the length of feeding the rope A1 precisely, namely the required lengths of sections of the rope A1 with specific braid densities. The quality of braiding may be affected. The conventional mode still needs improvement.

SUMMARY OF THIS INVENTION

An object of this invention is to provide a braiding apparatus capable of braiding a rope with different braid densities, namely capable of dividing the same rope into sections with different density of twisting strands and controlling the lengths of the fed sections precisely.

A braiding apparatus of this invention includes a base, a strand supplier configured for introducing at least one core strand to the base, a plurality of strand carriers with carrier strands movably mounted or shuttling on the base for twisting the carrier strands that wraps the core strand to form a braided rope, a guiding pulley disposed above the strand carriers for passing the rope around the guiding pulley, a control device connected to the guiding pulley, and a strand collector configured for collecting the rope which passes around the guiding pulley. The control device includes a driving source connected to the guiding pulley and capable of driving the guiding pulley at different rotational speeds, at least one recognition unit arranged on the guiding pulley, a sensor disposed relative to the guiding pulley, and a controller electrically connected to the sensor and the driving source. Accordingly, the guiding pulley driven by the driving source is precisely controlled by the controller to operate at different rotational speeds, thereby pulling the rope at different speeds and allowing the carrier strands to get twisted around the outer periphery of the core strand by different twisting performances. Therefore, a single rope can be divided into sections each have a specific braid density. The number of the recognition unit passing the sensor can be counted by the sensor during a periodic rotation of the guiding pulley to detect its rotating state. The use of the sensor cooperates with the controller which operatively changes the rotational speed of the driving source in order to subject the rope to different speeds of pulling whereby lengths of different sections of the rope with different braid densities can be precisely controlled to meet the demand.

Preferably, the driving source is a servo motor that allows for precise control of speed of rotation.

Preferably, in one preferred embodiment, the recognition unit can be a through hole formed on the guiding pulley. In other preferred embodiment, the recognition can be a recognition block disposed on the guiding pulley. The sensor is disposed beside the guiding pulley to find the number of the through hole or the recognition block passing the sensor when the guiding pulley rotates.

The advantages of this invention are more apparent upon reading the following descriptions in conjunction with the drawings.

BRIEF DESCRIPTION OF THE DRAWINGS

FIG. 3A is an enlarged view of FIG. 3;

FIG. 5 is an enlarged view showing the twisted rope generated by the braiding apparatus of this invention;

FIGS. 5A and 5B are enlarged views of FIG. 5;

DETAILED DESCRIPTION OF THE PREFERRED EMBODIMENTS

Figure 1:
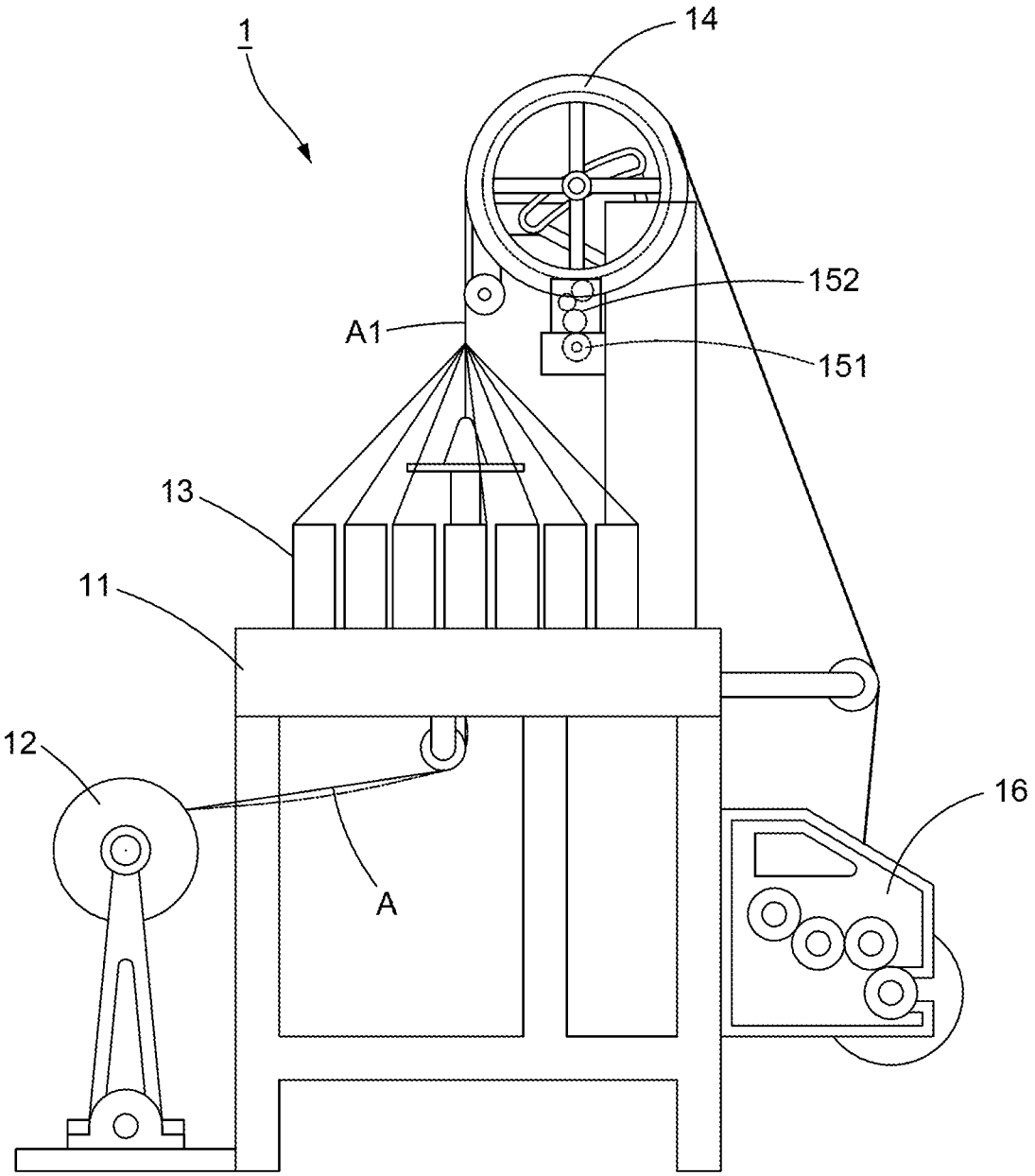
FIG. 1 (PRIOR ART)
FIG. 1 is a schematic view showing a conventional structure.
Figure 2:
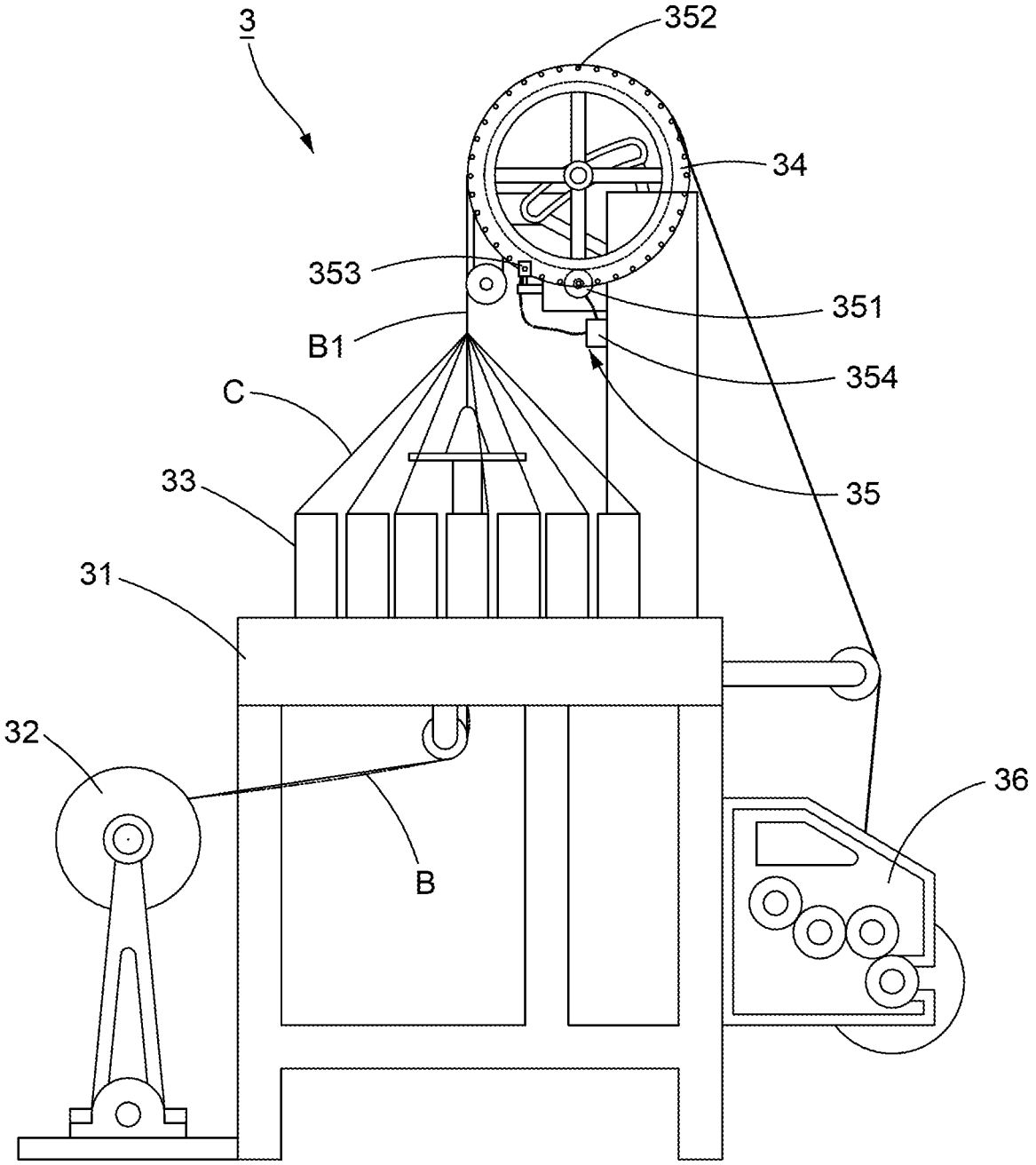
FIG. 2 is a schematic view showing a first preferred embodiment of this invention.

Referring to FIG. 2, a braiding apparatus 3 of a first preferred embodiment of this invention includes a base 31, a strand supplier 32 with at least one core strand B configured for introducing or feeding the core strand B to the base 32, a plurality of strand carriers 33 movably mounted or shuttling on the base 31 and provided with carrier strands C for wrapping the core strand B and then twisting together to form a braided rope B1, a guiding pulley 34 disposed above the strand carriers 33 for passing the rope B1 around the guiding pulley 34, a control device 35 connected to the guiding pulley 34, and a strand collector 36 configured for collecting the rope B1 which passes around the guiding pulley 34.

Figure 3:
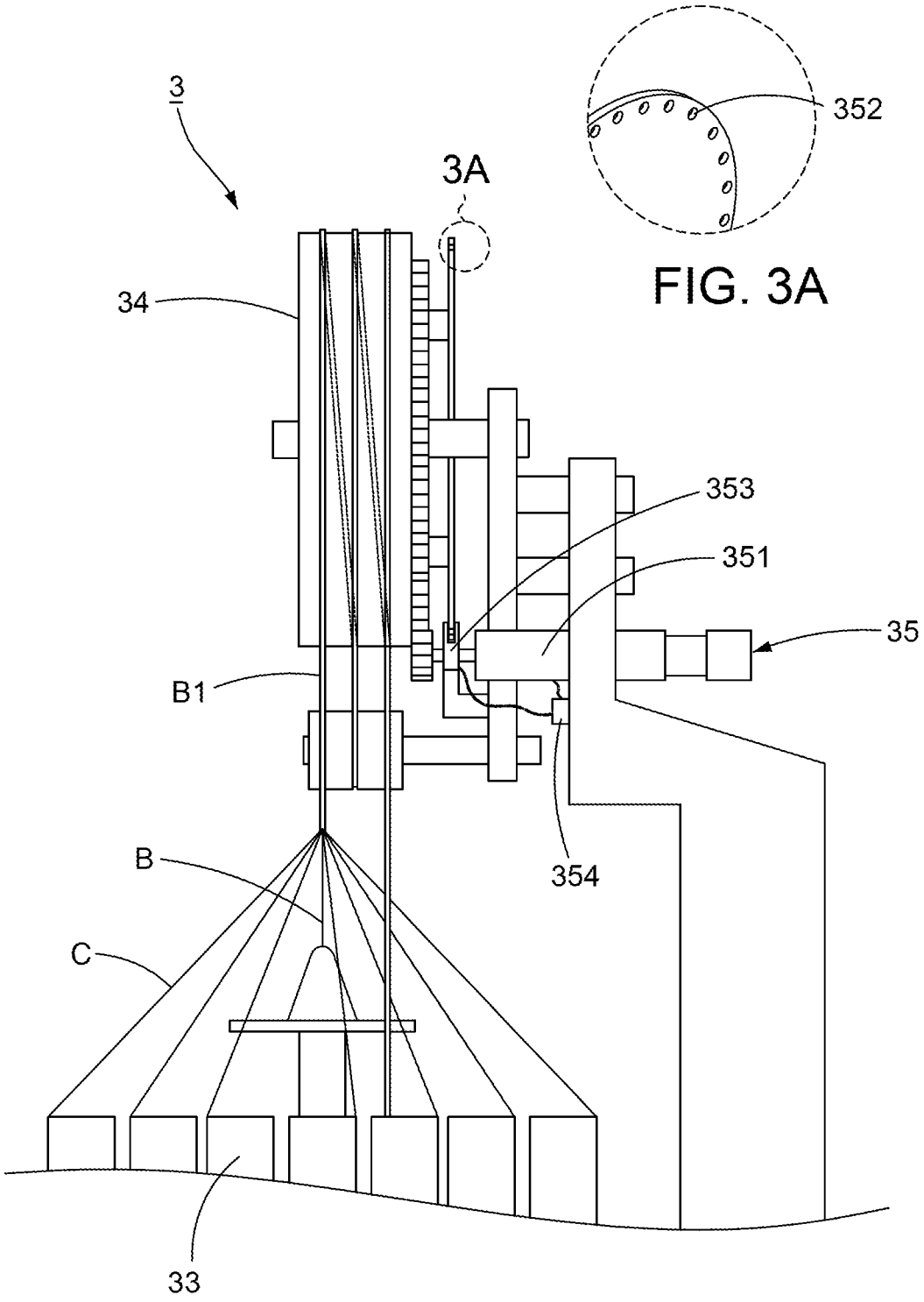
FIG. 3 is a partial schematic view showing the first preferred embodiment of this invention.

Further referring to FIG. 3, the control device 35 includes a driving source 351 connected to the guiding pulley 34 and capable of operating the guiding pulley 34 at various rotational speeds, at least one recognition unit 352 arranged on the guiding pulley 34, a sensor 353 disposed relative to the guiding pulley 34 and cooperating with the recognition unit 352, and a controller 354 electrically connected to the sensor 353 and the driving source 351 and controlling an operation of the driving source 351. In this preferred embodiment, the driving source 351 can be a servo motor that allows for precise control of the rotational speed under the control of the controller 354, thereby changing the speed of rotation of the driving source 351 and the guiding pulley 34 to facilitate the change in the braiding effect. Moreover, there can be a plurality of spaced-apart recognition units 352 in the form of through holes arranged on the guiding pulley 34, as shown in FIG. 3A. The sensor 353, preferably, can be located on one side of the guiding pulley 34. When the recognition units 352, namely the through holes, change their positions by the rotation of the guiding pulley 34 and pass the sensor 353 in sequence, the sensor 353 detects and counts the passing of the through holes 353 to calculate how long the rope B1 is pulled or carried by the guiding pulley 34 per desired section provided with a required braid density. In other words, lengths of different sections of the same rope B1 can be measured according to the number of the passing of the through holes 353, and those sections can have braid densities different from each other under the control of the control device 35.

Figure 4:
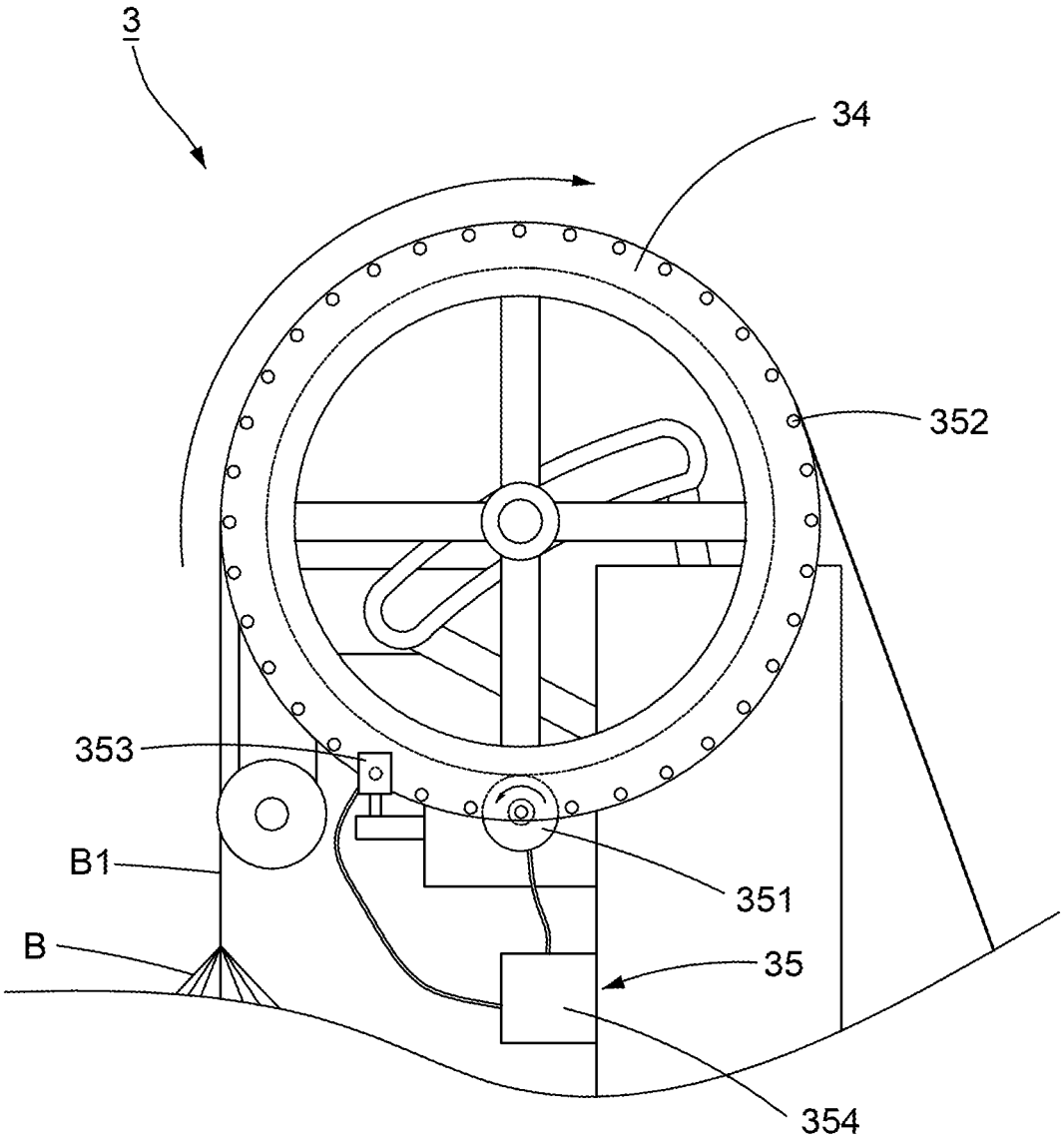
FIG. 4 is a schematic view showing the first preferred embodiment of this invention in use.

The operation of this invention is described with the aid of FIG. 3 and FIG. 4. The strand supplier 32 supplies the core strand B, and the core strand B goes through the base 31. The strand carriers 33 supply the carrier strands C to wrap the core strand B and concurrently shuttle on the base 31 to allow the carrier strands C to be twisted together around the outer periphery of the core strand B, thereby forming a twisted or braided rope B1. The rope B1 then passes around the guiding pulley 34 and goes to the strand collector 36, and the strand collector 36 rolls up the rope B1 to complete the braiding operation. To provide the same rope B1 with different braid densities during the braiding operation, the controller 354 controls the change in the rotational speed of the driving source 351, and the driving source 351 adjusts the speed of rotating the guiding pulley 34 synchronously. Because the shuttling speed of the strand carriers 33 remains unchanged, the change in the rotational speed of the guiding pulley 34 has control of the braid density. For example, when the guiding pulley 34 rotates slower, the rope B1 is pulled slowly. This indicates that the core strand B is introduced or fed into the base 31 slowly, so the carrier strands C of the strand carrier 33 have more time to wrap the core strand B and twisting with each other more closely. Therefore, the twisting space between carrier strands C is smaller to perform a denser or closer braiding effect, as shown in FIG. 5A. When the guiding pulley 34 rotates faster, the rope B1 is pulled quickly. This indicates that the core strand B is fed quickly. This faster action causes a quicker movement of the core strand B, so the carrier strands C of the strand carrier 33 has less time to get twisted around the outer periphery of the core strand B. Therefore, the twisting space between carrier strands C is larger to perform a less dense braiding effect, as shown in FIG. 5B.

Moreover, during the braiding operation caused by the rotation of the guiding pulley 34, e.g. by a cycle of the rotation, the sensor 353 records the number of the recognition units 352 (through holes 352) which pass the sensor 353 in order to obtain an exact state of rotating the guiding pulley 34 and pulling the rope B1. In other words, the rope B1 is divided into sections according to the counted number, and the distance of the passing decides the range of each selected section to measure the length of feeding the rope B1. By feeding the rope by a desired length and controlling the driving source 351 with the controller 354 to provide various rotational speeds, the same rope B, shown in FIG. 5, can be easily, quickly and precisely divided into sections with different lengths, and the braid densities of the sections can be different from each other to provide variety and meet the demand.

Figures 6, 6A:
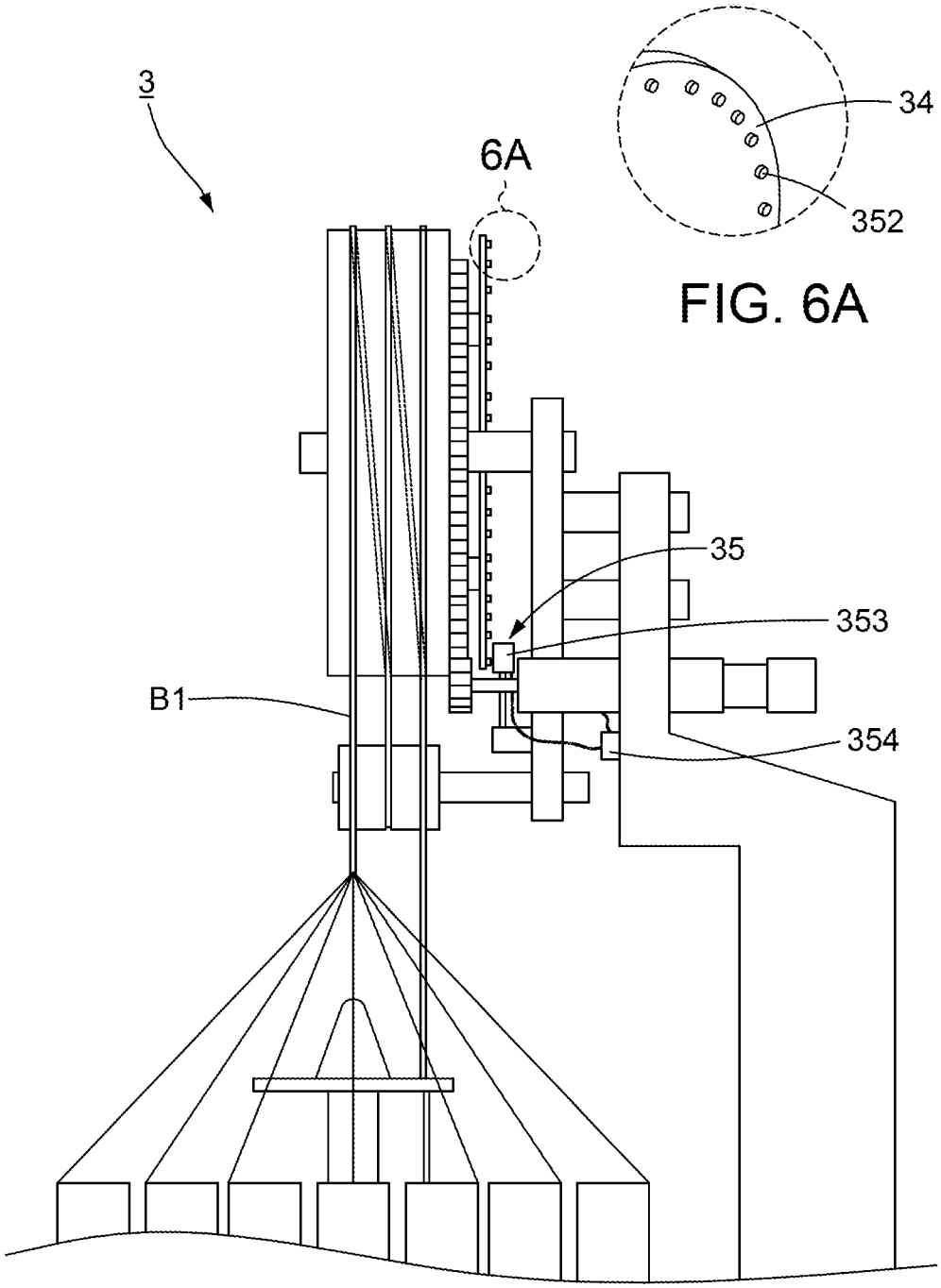
FIG. 6 is a schematic view showing a second preferred embodiment of this invention.
FIG. 6A is an enlarged view of FIG. 6.

Referring to FIG. 6, a braiding apparatus 3 of a second preferred embodiment includes a base 31, a strand supplier 32, strand carriers 33, a guiding pulley 34, a control device 35 and a strand collector 36. The concatenation of correlated elements, operations and objectives of this preferred embodiment are correspondent with those of the first preferred embodiment and herein are omitted. This preferred embodiment is characterized in that the recognition unit 352 is a recognition block disposed on the guiding pulley 34, as shown in FIG. 6A, and the sensor 353 is still disposed on one side of the guiding pulley 34. Accordingly, when the guiding pulley 34 rotates to make the spaced-apart recognition blocks 352 change their positions, the sensor 353 records how many recognition blocks 352 pass the sensor 353. The controller 354 can confirm the state of the rotation of the guiding pulley 34 according to the counting of the sensor 353 and then adjust the speed of rotating the guiding pulley 34 precisely. Therefore, the cooperation between the controller 354 and the sensor 353 assists the braiding apparatus 3 in braiding a rope B1 having different braid densities at different sections.

To sum up, this invention takes advantage of the counting of the sensor to measure the length of feeding sections of the rope and also uses the controller to facilitate the change in the rotational speed of the driving source. The cooperation allows the guiding pulley driven by the driving source to pull the rope by different speeds, with the result that the strand carriers braid around the core strand with different braid densities precisely. Therefore, different sections of the same rope with different braid densities and the desired length values of the sections can be precisely controlled to meet various needs.

While the embodiments of this invention are shown and described, it is understood that further variations and modifications may be made without departing from the scope of this invention.

What is claimed is:

1. A braiding apparatus capable of generating one twisted rope with different braid densities comprising:

a base;

a strand supplier configured for feeding at least one core strand to said base;

a plurality of strand carriers with carrier strands movably mounted on said base, with said carrier strands of said strand carriers wrapping said core strand and then being braided together to form a braided rope;

a guiding pulley disposed above said strand carriers for allowing said braided rope to pass around said guiding pulley;

a control device connected to said guiding pulley; and a strand collector configured for rolling up said braided rope which passes around said guiding pulley;

wherein said control device includes a driving source connected to said guiding pulley and capable of operating said guiding pulley at different rotational speeds, at least one recognition unit arranged on said guiding pulley, a sensor disposed relative to said guiding pulley and cooperating with said recognition unit, and a controller electrically connected to said sensor and said driving source and controlling an operation of said driving source;

wherein said sensor detects passage of said recognition unit relative thereto under a rotation of said guiding pulley; and wherein said controller controls said driving source to operate at different rotational speeds responsive to a rotational displacement of said guiding pulley, and to thereby drive said guiding pulley to pull said braided rope at different speeds, said carrier strands of said strand carriers thereby being wrapped around said core strand and braided together in different braid densities.

2. The braiding apparatus according to claim 1, wherein said driving source is a servo motor.

3. The braiding apparatus according to claim 1, wherein said at least one recognition unit is a through hole formed on said guiding pulley, and said sensor is disposed on one side of said guiding pulley to count the number of said through hole which passes said sensor.

4. The braiding apparatus according to claim 2, wherein said at least one recognition unit is a through hole formed on said guiding pulley, and said sensor is disposed on one side of said guiding pulley to count the number of said through hole which passes said sensor.

5. The braiding apparatus according to claim 1, wherein said at least one recognition unit is a recognition block disposed on said guiding pulley, and said sensor is disposed on one side of said guiding pulley to count the number of said recognition block which passes said sensor.

6. The braiding apparatus according to claim 2, wherein said at least one recognition unit is a recognition block disposed on said guiding pulley, and said sensor is disposed on one side of said guiding pulley to count the number of said recognition block which passes said sensor.

7. The braiding apparatus according to claim 1, further comprising a plurality of said recognition units, and said sensor is configured to count the number of said recognition units passing said sensor under a rotation of said guiding pulley.

8. A braiding apparatus capable of generating one rope with different braid densities comprising:

a base;

a strand supplier configured for feeding at least one core strand to said base;

a plurality of strand carriers with carrier strands movably mounted on said base, with said carrier strands of said strand carriers wrapping said core strand and then being braided together to form a braided rope;

a guiding pulley disposed above said strand carriers for allowing said braided rope to pass around said guiding pulley;

a control device connected to said guiding pulley; and a strand collector configured for rolling up said braided rope which passes around said guiding pulley;

wherein said control device includes a driving source connected to said guiding pulley and capable of operating said guiding pulley at different rotational speeds, at least one recognition unit arranged on said guiding pulley, a sensor disposed relative to said guiding pulley and cooperating with said recognition unit, and a controller electrically connected to said sensor and said driving source and controlling an operation of said driving source;

wherein said sensor detects passage of said recognition unit relative thereto under a rotation of said guiding pulley; and wherein said controller controls said driving source to operate at different rotational speeds responsive to a rotational displacement of said guiding pulley, and to thereby drive said guiding pulley to pull said braided rope at different speeds, a shuttling speed of said strand carriers remaining unchanged when rotational speeds of said driving source and of said guiding pulley change, said carrier strands of said strand carriers thereby being wrapped around said core strand and braided together in different braid densities.

* * * * *